United States Patent [19]

McDowell

[11] 4,169,167

[45] Sep. 25, 1979

[54] LOW GLOSS FINISHES BY GRADIENT INTENSITY CURE

[75] Inventor: John R. McDowell, Erie, Pa.

[73] Assignee: Lord Corporation, Erie, Pa.

[21] Appl. No.: 918,983

[22] Filed: Jun. 26, 1978

[51] Int. Cl.[2] ..... B05D 3/06

[52] U.S. Cl. ..... 427/54; 204/159.15; 204/159.23

[58] Field of Search ..... 427/54, 53; 204/159.15, 204/159.16, 159.19, 159.23

[56] References Cited

U.S. PATENT DOCUMENTS

| | | | |
|---|---|---|---|
| 3,759,807 | 9/1973 | Osborn et al. | 204/159.23 |
| 3,759,808 | 9/1973 | Parker et al. | 204/159.23 |
| 3,783,004 | 1/1974 | Parker | 427/54 |
| 3,850,675 | 11/1974 | Miller | 427/54 |
| 3,918,393 | 11/1975 | Hahn | 204/159.19 |
| 3,943,046 | 3/1976 | DeSorga et al. | 204/159.23 |
| 3,953,622 | 4/1976 | Wismer et al. | 427/54 |
| 3,966,572 | 6/1976 | Carder | 427/54 |
| 3,992,275 | 11/1976 | Shahidi et al. | 204/159.19 |
| 4,017,652 | 4/1977 | Gruber | 204/159.23 |
| 4,020,193 | 4/1977 | Wismer et al. | 427/54 |
| 4,048,036 | 9/1977 | Prucnal | 427/54 |
| 4,075,366 | 2/1978 | Packer | 427/54 |

*Primary Examiner*—John H. Newsome

*Attorney, Agent, or Firm*—John A. Gazewood

[57] ABSTRACT

The gloss of energy-curable coating and ink compositions is reduced by exposing such compositions to actinic radiation in an oxygen-rich atmosphere at differential intensity levels. The intensities are selected to effect at a first intensity range substantially complete cure of the composition except for the surface, with final cure of the surface being effected subsequently at a different and higher intensity range. Gradient Intensity Cure can be employed with substantially any composition which is curable by free radical-induced addition polymerization using a photosensitizer-photoinitiator photocatalyst system.

12 Claims, No Drawings

LOW GLOSS FINISHES BY GRADIENT INTENSITY CURE

This invention relates to energy-curable compositions. More particularly, the invention relates to energy-curable coating and ink compositions which can be cured to a finish having a reduced gloss by exposure to actinic radiation in an oxygen-rich environment.

The need to reduce solvent emissions and to conserve energy in chemical processes, such as in the paint, coating and ink industries, has resulted in an acceleration of the development of 100 percent reactive systems, that is, substantially all of the components, excluding nonreactive materials such as fillers and pigments, react during curing to become an integral part of the cured film or coating. Such systems generally produce significantly less organic emissions and cure with less energy consumption as compared to coating and ink lacquers which contain significant amounts of volatile inert organic solvents.

Typically, energy-curable compositions are composed of a mixture of various reactive components which cure by addition polymerization through a free radical mechanism. Each component is designed to perform a specific function in both the uncured composition and the cured film. The components include (1) a reactive low-to-medium molecular weight polymer, generally referred to as an oligomer, which imparts primary performance characteristics to the cured film; (2) monofunctional and polyfunctional monomers which can contribute to the degree of crosslinking required in the cured film and otherwise function as reactive diluent to adjust the viscosity of the formulation to a level suitable for application; and, (3), various nonreactive, specialty components such as fillers, colorants, slip agents, and release agents, which are added for various end-use properties. While these addition-polymerizable compositions can be cured by any free radical means, including redox catalyst systems and free radical generators, the term "energy-curable" generally encompasses those formulations which are curable by exposure to actinic radiation or ionizing radiation. While ionizing radiation possesses sufficient energy to initiate the free radical addition polymerization reaction, actinic radiation generally requires a photoinitiation system, whose function in the actinic radiation-curable formulation is comparable to the redox catalyst systems and the free radical generators such as benzoyl peroxide in room temperature and heat curable systems.

Because cure is effected through free radical polymerization of reactive oligomers and polymers that form the binder portion of the compositions, energy-curable formulations contain substantially no volatile solvents which must be evaporated during the cure cycle. From pollution, cost, safety and health points of view, the advantages of energy-curable formulations are readily apparent. However, the curing of such formulations generally results in glossy films. Many applications, such as the furniture industry, desire a lower gloss than is obtainable with standard energy-curable processes. With the conventional inert solvent-based lacquer compositions, gloss reduction can be obtained by adding a flatting agent such as silica to the coating or ink formulation. Flatting, that is, gloss reduction, is effected with such conventional lacquers by evaporation of the inert solvent and shrinkage of the film during the curing cycle, which results in exposure of pigment particles above the surface of the cured film. Because energy-curable formulations contain little if any volatile inert organic solvents, the conventional method of gloss reduction through evaporation of solvent and film shrinkage to expose flatting agent particles is ineffective to provide desired levels of glass reduction. For example, while the gloss of energy-curable films can be reduced by adding flatting agents such as silica, an equal amount of the flatting agent based on resin solids is not as effective for reducing gloss of the energy-cured film as the same amount in a 50% solids lacquer. Further, the addition of flatting agents increases the viscosity of the formulations to such an extent that a proper application viscosity cannot be maintained. The resulting undesirable high viscosities cannot be adjusted simply by increasing the volume of reactive diluent because an imbalance in the oligomer-reactive diluent ratio results in separation of the formulations into distinct resin and diluent phases and can adversely affect ultimate film properties. In addition, many flatting pigments, such as calcium stearate zinc stearate, aluminum rosinate, talc and clay, not only increase viscosities to inoperably high levels but also exhibit a blocking effect on actinic irradiation. This phenomenon not only adversely affects ultimate film properties but also extends cure times and, in many instances, regardless of the length of exposure to actinic radiation, will not provide a satisfactory degree of cure.

Among the proposed solutions to the problem of reducing the gloss of energy-curable compositions is the use of $\alpha,\alpha,\alpha$-trichlorotoluene as a photoinitiator. According to the patentees, Shahidi et al, U.S. Pat. No. 3,992,275, the use of this compound provides finishes which, when cured by ultraviolet radiation, are low in gloss and cure at essentially the same rate as nonmodified ultraviolet curable systems. The solution proposed by Carder, U.S. Pat. No. 3,966,572, involves the use of acrylic acid and silica to produce lower gloss films. According to the patentee, the acrylic acid permits the use of silica as a flatting agent without appreciable increases in viscosity and thixotropy. Hahn, U.S. Pat. No. 3,918,393, discloses a two-step method of producing flat or non-glossy films comprising subjecting a substantially solventless, radiation-sensitive material to ionizing irradiation or actinic light in an atmosphere containing at least 5000 parts per million of oxygen and subsequently subjecting the material to ionizing irradiation or actinic light in an inert gas such as nitrogen or an atmosphere containing less than 1000 parts per million of oxygen. While these proposals are effective to produce cured films having a reduced gloss, there nevertheless remains a need for other solutions.

It has now been discovered that films and coatings having commercially desired ultimate properties and a flat or low-gloss effect can be achieved by subjecting energy-curable formulations to actinic light in an oxygen-containing atmosphere. As used herein, the term "oxygen-containing atmosphere" refers to an environment or atmosphere containing at least 5000 parts per million of oxygen. Although it is well-known that the presence of oxygen inhibits actinic energy-induced free radical polymerization mechanism, it is a particular feature of this invention that such oxygen inhibition can be used to an advantage to obtain low gloss finishes.

Broadly, in accordance with the present invention, there is provided a process for producing a flatted or low gloss finish comprising subjecting an energy-curable composition to actinic light in an oxygen-containing atmosphere under conditions effective to cure the composition except for the surface and subsequently subjecting such composition to actinic light in an oxygen-containing atmosphere under conditions effective to completely cure the surface thereof. The invention further provides energy-curable compositions especially adapted to provide cured films having a matte, that is, flatted or low gloss finish.

More particularly, the invention provides a Gradient Intensity Cure process for producing low gloss finishes comprising subjecting an energy-curable composition to actinic radiation in an oxygen-containing atmosphere at a first intensity level and a first exposure time until the composition is completely cured except for the surface thereof and subsequently subjecting such composition having such uncured surface to actinic light at a second intensity level and a second exposure time to completely cure said surface, wherein said combination of second intensity and second exposure time is selected from the group consisting of (i) said second intensity is substantially equal to said first intensity and said second exposure time is greater than said first exposure time;

(ii) said second intensity is greater than said first intensity, and said second exposure time is substantially equal to said first exposure time;

(iii) said second intensity is greater than said first intensity, and said second exposure time is less than said first exposure time; and (iv) said second intensity is greater than said first intensity, and said second exposure time is greater than said first exposure time.

The energy-curable formulations of this invention comprise the following essential ingredients:

(a) at least one reactive oligomer;

(b) a reactive diluent;

(c) silica; and (d) a photocatalyst system.

Reactive oligomers which are employed in the low gloss formulations of the invention can include substantially any polymeric material characterized by the presence of at least one, preferably at least two, ethylenically unsaturated unit(s), and which is curable by free radical-induced polymerization using photoinitiators in the presence of actinic light. Such polymeric materials will exhibit a molecular weight of at least 600, and preferably in the range of 900 to 4500, and preferably will have from 0.5 to 3 units of $\alpha,\beta$-olefinic unsaturation per 1000 units of molecular weight. Representative of such materials are vinyl, acrylic, substituted acrylic, allylic, mercapto, fumaric, maleic and the like compounds having at least one unit of ethylenic unsaturation, including ethylenically unsaturated polyesters, polyethers, polyacrylates and substituted acrylates, epoxies, urethanes, silicones, amines, polyamides, and the like. A preferred class of polymeric materials includes the acrylated resins, such as acrylated silicone oil, acrylated polyesters, acrylated polyethers, acrylated polyurethanes, acrylated polyamides, acrylated polycaprolactones, acrylated soybean oil, acrylic and substituted acrylic resins, acrylated epoxies and acrylated urea resins, with acrylated polyurethane resins being particularly preferred. Such ethylenically unsaturated materials, including their manufacture, are well known, see Burlant et al U.S. Pat. No. 3,509,234 and Smith et al U.S. Pat. No. 3,700,643.

A particularly preferred class of polymeric materials comprise unsaturated urethane and analogous to urethane resins which are characterized by the presence of at least one ethylenically unsaturated unit having the structure $>C{=}C<$, said unsaturated resins comprising the reaction product of:

(i) at least one organic isocyanate compound characterized by the presence of at least two reactive isocyanate groups;

(ii) from about 30 to 100 mol percent of at least one polymeric material characterized by the presence of at least two isocyanate-reactive active hydrogen groups;

(iii) from about 70 to zero mol percent of at least one monomeric chain-extending compound characterized by the presence of at least two isocyanate-reactive active hydrogen groups; and (iv) at least one addition-polymerizable unsaturated monomeric compound having a single isocyanate-reactive active hydrogen group;

the mol percents of (ii) and (iii) being based on total mols of (ii) and (iii);

said isocyanate compound (i) being present in an amount sufficient to provide an NCO:active hydrogen ratio greater than 1:1, preferably at least 1.05:1, and more preferably in the range 2.3–5:1, with respect to the active hydrogen groups of (ii) and (iii);

said addition-polymerizable unsaturated monomeric compound (iv) being present in an amount sufficient to provide at least one molar equivalent of active hydrogen group per mol of available isocyanate moiety. Such preferred unsaturated resins will have a residual reactive isocyanate moiety, based on total weight of the resin, of not more than one, preferably not more than 0.1, percent by weight. The ethylenically unsaturated unit is preferably a terminal group having the structure $CH_2{=}CH{-}$. Such resins have the further characteristic features (a) the polymerizable ethylenically unsaturated group is separated from the main or backbone carbon-carbon chain by at least one, preferably at least two, urethane or analogous group(s) or combination of such groups;

(b) a molecular weight of at least 600, preferably 900 to 4500; and (c) the presence of 0.5 to 3 ethylenically unsaturated units per 1000 units of molecular weight.

Active hydrogen-containing precursors which can be employed in preparing the preferred ethylenically unsaturated reactive oligomers can be linear or branched and include any polymeric material having at least two isocyanate-reactive active hydrogen groups per molecule as determined by the Zerewitinoff method. Representative active hydrogen-containing polymeric compounds include polyethers, such as polyethylene glycol and polytetramethylene glycol; hydroxy-terminated polyalkylene esters of aliphatic, cycloaliphatic and aromatic diacids; esters of polyhydric alcohols and hydroxy fatty acids; alkyd resins containing hydroxyl end groups; hydroxyl-terminated polybutadiene resins; hydroxylated acrylic and substituted acrylic resins; hydroxyl-terminated vinyl resins; polycaprolactones; polythiols; polyamine and polyamide resins and the like. Currently, hydroxyl-containing compounds are preferred.

Organic isocyanate compounds suitable for use in forming the preferred unsaturated resins in accordance with the invention can be any organic isocyanate compound having at least two reactive isocyanate groups. Included within the purview of such isocyanate compounds are aliphatic, cycloaliphatic, and aromatic polyisocyanates as these terms are generally interpreted in the art. Thus, it will be appreciated that any of the known polyisocyanates such as alkyl and alkylene polyisocyanates, cycloalkyl and cycloalkylene polyisocyanates, and aryl and arylene polyisocyanates, including variants thereof, such as alkylene cycloalkylene and alkylene arylene polyisocyanates, can be employed. Suitable polyisocyanates include, without limitation, tolylene-2,4-diisocyanate, 2,2,4-trimethylhexamethylene-1,6-diisocyanate, hexamethylene-1,6-diisocyanate, diphenylmethane-4,4'-diisocyanate, triphenylmethane-4,4',4''-triisocyanate, polymethylene poly(phenyl isocyanate), m-phenylene diisocyanate, 2,6-tolylene diisocyanate, 1,5-naphthalene diisocyanate, naphthalene-1,4-diisocyanate, diphenylene-4,4'-diisocyanate, 3,3'-bitolylene-4,4'-diisocyanate, 1,4-cyclohexylene dimethylene diisocyanate, xylene-1,4-diisocyanate, cyclohexyl-1,4-diisocyanate, 4,4'-methylene-bis-(cyclohexyl diisocyanate) 3,3'-diphenyl methane-4,4'-diisocyanate, isophorone diisocyanate, dimer isocyanates such as the dimer of tolylene diisocyanate, and the product obtained by reacting trimethylol propane and 2,4-tolylene diisocyanate in a molar ratio of 1:3. Currently, aliphatic and cycloaliphatic diisocyanates are preferred.

Essentially any monomeric compound having at least two isocyanate-reactive active hydrogen groups which is known to or can be expected to function as a chain-extender to increase molecular weight, introduced chain-branching, affect flexibility and the like in reactions between isocyanate compounds and compounds containing active hydrogen groups can be employed in forming the preferred unsaturated resins of the invention. Such chain extending compounds are well known in the art and require no detailed elaboration. Preferably, the active hydrogen groups of such chain extending compounds will be selected from among hydroxyl, thiol, primary amine and secondary amine, including mixtures of such groups, with hydroxyl and primary amine being currently preferred. The chain extending compounds will generally have molecular weights of less than 25, and preferably between 50 and 225. Especially preferred chain extending compounds include aliphatic diols free of alkyl substitution and aliphatic triols having from 2 to 14 carbon atoms. Representative chain extending compounds include ethylene glycol, 1,3-propane diol, 1,4-butane diol, 1,6-hexane diol, trimethylol propane, triethylene glycol, glycerol, 1,2-propane-bis(4-cyclohexyl amine), methane-bis(4-cyclohexyl amine), N,N'-dimethyl-o-phenylene diamine, 1,3-propane dithiol, monoethanol amine, and amino ethyl mercaptan.

Suitable addition-polymerizable monomeric compounds having a single ethylenically unsaturated unit and a single isocyanate-reactive hydroxyl active hydrogen group which can be used in the preferred compositions of this invention include 2-hydroxyethyl acrylate, 3-hydroxypropyl acrylate, 4-hydroxybutyl acrylate, 8-hydroxyoctyl acrylate, 12-hydroxydodecanyl acrylate, 6-hydroxyhexyl oleate, hydroxy neopentyl acrylate, hydroxyneopentyl linoleate hydroxyethyl-3-cinnamyloyloxypropyl acrylate, hydroxyethyl vinly ether, and the corresponding methacrylates, and allyl alcohol.

The preferred unsaturated resins of the invention can be prepared by any of several reaction routes. For example, the isocyanate compound, the polymeric material having at least two active hydrogen groups, the addition-polymerizable monomeric compound having a single ethylenically unsaturated group and a single isocyanate-reactive active hydrogen group and, when used, the chain-extending compound can be simultaneously reacted together. Currently, it is preferred to form the unsaturated resins in two or more steps comprising (1) reacting the isocyanate compound, the polymeric material, and, if used, the chain-extending compound to provide an isocyanate-functional prepolymer and (2) reacting the prepolymer with the addition-polymerizable unsaturated monomeric compound having a single isocyanate-reactive active hydrogen group. The reaction is terminated at the desired state of viscosity, which will generally correspond to a molecular weight of at least 600, preferably 900 to 4500, which is usually a function of an end-use requirement. Any excess isocyanate moieties can be capped if desired or necessary by the addition of monofunctional chain-terminating agents, such as monoalcohols and monoamines, preferably having from one to 4 carbon atoms, and morpholine. Regardless of the process employed, it is preferred to conduct the reaction in its entirety in the presence of a diluent phase which is copolymerizable with the unsaturated resin product but is inert with respect to the manufacture of the resin.

Reactive diluent systems which can be employed in the addition-polymerizable compositions of this invention include any of such systems which have been or are being used for this purpose. Broadly, suitable reactive diluent systems comprise at least one unsaturated addition-polymerizable monomer which is copolymerizable with the unsaturated resin. The reactive diluent can be monofunctional or polyfunctional. A single polyfunctional diluent can be used, as can mixtures thereof, or a combination of one or more monofunctional reactive diluents and one or more polyfunctional reactive diluents can be used. Such combinations of mono- and polyfunctional reactive diluents are currently preferred. Generally, the reactive diluent system will comprise from about 10 to about 75, preferably about 25 to about 50, weight percent, based on total weight of unsaturated resin and reactive diluent, of the addition-polymerizable compositions of the invention. Particularly preferred reactive diluents are unsaturated addition-polymerizable monofunctional monomeric compounds selected from the group consisting of esters having the general formula

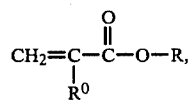

wherein R° is hydrogen or methyl and R is an aliphatic or cycloaliphatic, preferably alkyl or cycloalkyl, group having from 6 to 18, preferably 6 to 9 carbon atoms. Representative of such preferred reactive monomeric diluents, without limitation thereto, are hexyl acrylate, cyclohexyl acrylate, 2-ethylhexyl acrylate, octyl acrylate, nonyl acrylate, stearyl acrylate, and the corresponding methacrylates. It is preferred that at least 50 percent by weight of the reactive diluent comprise one or more of these preferred esters. Illustrative of other reactive monofunctional and polyfunctional monomeric diluents which can be employed are styrene, methyl methacrylate, butyl acrylate, isobutyl acrylate, 2-phenoxy acrylate, ethoxyethoxyethyl acrylate, 2-methoxyethyl acrylate, 2-(N,N'-diethylamino)-ethyl acrylate, the corresponding methacrylates, acrylonitrile, methyl acrylonitrile, methacrylamide, neopentyl glycol diacrylate, ethylene glycol diacrylate, hexylene glycol diacrylate, diethylene glycol diacrylate, trimethylol propane triacrylate, pentaerythritol di-, tri-, or tetra-acrylate, the corresponding methacrylates, vinyl pyrrolidone, and the like. Reactive diluent systems are well-known to those skilled in the art of readiation curing and the selection of an appropriate diluent system in any given instance is sufficiently encompassed by such knowledge as to require no further discussion here.

It is an essential feature of this invention that the actinic energy-curable compositions suitable for use in the practice of the invention must contain a flatting agent. The use of compositions which do not contain flatting agent does not provide any effective degree of gloss reduction. It is a unique feature of the invention that, of the known flatting agents such as silica, polyethylene, talc, clay, calcium stearate, zinc stearate and aluminum stearate, the only flatting agent which will provide a noticeable reduction in gloss is silica. While substantially any of the known silicas can be employed to effect gloss reduction in accordance with this invention, silane-treated silicas are currently preferred. It is another feature of the present invention that the amount of silica must be within the range of 1 to 12, preferably 6 to 10, percent by weight based on total weight of unsaturated resin, reactive diluent and flatting agent.

It is also an essential feature of the invention that actinic radiation curable compositions employed in the practice of the present invention contain a photocatalyst system comprising a mixture of (1) at least one compound which promotes free radical addition polymerization through bimolecular photochemical reactions of the energy donor or transfer type or hydrogen abstraction type, or by formation of a donor-acceptor complex with monomers or additives leading to ionic or radical species and (2) at least one compound which promotes free radical addition polymerization by generating reactive specie by way of unimolecular homolysis resulting from photoexcitation.

Compounds (1) which are effective to promote free radical addition polymerization through bimolecular photochemical reactions of the energy donor or transfer type or hydrogen abstraction type of by formation of a donor-acceptor complex with monomers or additives leading to ionic or radical species are well known, as are compounds (2) which are effective to promote free radical addition polymerization by generating reactive specie, such as free radicals, by way on unimolecular scission resulting from photoexcitation. Such compounds (1) and (2) are described as photosensitizers and photoinitiators, respectively, by at least one patentee, see Gruber U.S. Pat. No. 4,017,652 and, for the purpose of establishing some measure of consistency with respect to nomenclature, that description will be followed herein. With respect to photopolymerization processes, photosensitizers are not good initiators per se, but do readily absorb photons to produce an excited molecule which then acts through energy transfer, hydrogen abstraction or formation of a donor-acceptor complex with a second molecule to produce free radicals which are capable of initiating additional polymerization reactions. Unlike the photosensitizers which form free radicals through interaction with a second molecule, photoinitiators absorb photons to produce an excited molecule which can cleave to produce free radicals which are capable of initiating addition polymerization reactions.

Particularly preferred photosensitizers, which are an essential first component of the photocatalyst systems employed in the practice of this invention, are aromatic ketones and aromatic aldehydes which can exist in a triplet state, especially such ketones and aldehydes which have a triplet energy in the range from 35 to 85, preferably 42 to 72, kilocalories per mole. Such photosensitizers are described in Gruber U.S. Pat. No. 4,017,652 and Osborn et al U.S. Pat. No. 3,759,807, the disclosures of both patents being incorporated herein by reference.

Photoinitiators, which are an essential second component of the photocatalyst systems employed in the practice of this invention, are preferably selected from compounds having the formula

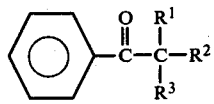

1.

wherein $R^1$, $R^2$ and $R^3$ are independently hydrogen, hydroxyl, halogen, alkyl of 1 to 12, preferably 1 to 8, carbon atoms, alkoxy of 1 to 12, preferably 1 to 8, carbon atoms, or phenyl, providing that $R^1$, $R^2$ and $R^3$ are not concurrently all hydrogen, hydroxyl, halogen, or alkyl; and wherein at least one of $R^1$, $R^2$ or $R^3$ is preferably hydroxyl or alkoxy. The alkyl, alkoxy and phenyl groups can be substituted with moieties which will not interfere with the function of the compound as a photoinitiator. Representative substituent moieties or groups include halogen, alkyl of 1 to 8 carbon atoms, alkoxy having from 1 to 8 carbon atoms in the alkyl group, carboxy and carbalkoxy having from 1 to 8 carbon atoms in the alkyl groups. Photoinitiators in which the alkyl, alkoxy and phenyl groups are unsubstituted are preferred. A second class of preferred photoinitiators has the formula

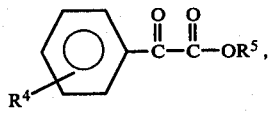

2.

wherein $R^4$ is hydrogen, halogen, alkoxy containing from 1 to 8, preferably 1 to 4, carbon atoms or alkyl containing from 1 to 8, preferably 1 to 4 carbon atoms; and $R^5$ is hydrogen, alkyl containing from 1 to 22 carbon atoms, benzyl, phenyl, hydroxyalkyl containing from 1 to 12 carbon atoms, haloalkyl containing from 1 to 12 carbon atoms, alkoxyalkyl wherein the alkoxy portion contains from 1 to 8 carbon atoms and the alkyl portion contains from 1 to 12 carbon atoms, and phenoxyalkyl wherein the alkyl portion contains from 1 to 12 carbon atoms, $R^5$ being preferably hydrogen, alkyl of 1 to 12 carbon atoms, benxyl or phenyl.

Particularly preferred photoinitiator compounds are represented by the formulae

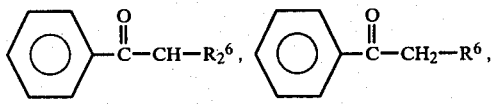

-continued

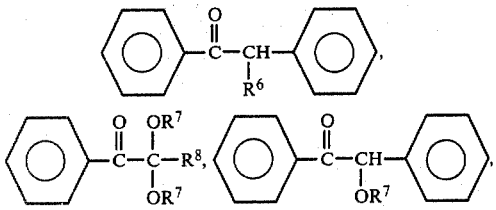

wherein $R^6$ is halogen; $R^7$ is an alkyl group having from 1 to 12, preferably 1 to 8, carbon atoms; and $R^8$ is hydrogen, alkyl of 1 to 12 carbon atoms, aryl of 6 to 14 ring carbon atoms, and cycloalkyl of 5 to 8 ring carbon atoms. Where a plurality of $R^6$ or $R^7$ groups are found on the molecule, they can be the same or different.

The photoinitiators which are employed in combination with the heretofore described photosensitizers in the practice of the invention are well-known articles of commerce. A representative listing of such compounds can be found in U.S. Pat. No. 4,017,652, column 4, lines 46–63; U.S. Pat. No. 4,024,296, column 4, lines 18–37; and U.S. Pat. No. 3,715,293, column 1, line 41 through column 2, line 13.

Presently preferred photocatalyst systems comprise admixtures of, (a), benzophenone and benzoin isobutyl ether and, (b), benzophenone and 2,2-diethoxyacetophenone.

It has also been found that the inclusion of chain transfer agents in the energy-curable compositions employed in the practice of this invention can beneficially affect ultimate cured film properties. Substantially any of the known chain transfer agents can be so employed. Generally, such compounds, when utilized, will be employed at levels not exceeding about 15 parts by weight, per 100 parts of combined weight of unsaturated urethane oligomer and reactive diluent, and preferably will be employed in the range from about 0.1 to about 5 parts by weight. Representative chain transfer agents for addition polymerization reactions include benzene; toluene; ethylbenzene, isopropylbenzene; t-butylbenzene; cyclohexane; heptane; n-butyl chloride; n-butyl bromide; n-butyl iodine; n-butyl alcohol; n-butyl disulfide; acetone; acetic acid; chloroform; carbon tetrachloride; carbon tetrabromide; butylamine; triethylamine; t-butyl mercaptan; n-butyl mercaptan; tertiary aliphatic amines such as triethanolamine and t-butyl diethanolamine; 2-ethylhexane-1, 3-dithiol; 1,10-decanedithiol' 1,2-ethanedithiol; 1,3-propanedithiol' 1,6-octanedithiol; 1,8-octanedithiol; 1,10-octadecanedithiol; m-benzenedithiol; bis-(2-mercaptoethyl) sulfide; p-xylylenedithiol; pentaerythritol tetra-7-mercaptoheptanoate; mercaptoacetic acid triglyceride; pentanethiol; dodecanethiol; glycol mercaptoacetate; ethyl mercaptoacetate; and esters of thioglycolic and mercaptopropionic acids. Preferred chain transfer agents include both monothiols and polythiols; the polythiols having a molecular weight in the range from about 95 to about 20,000 and having the general formula $$R^9(SH)_m,$$

wherein $R^9$ is a polyvalent organic moiety and m is at least 2, being especially preferred. Particularly preferred polythiols include glycerol trithioglycolate; pentaerythritol tetrathioglycolate; pentaerythritol tetrakis ($\beta$-mercaptopropionate); trimethylolpropane tris(thioglycolate); trimethylolpropane tris($\beta$-mercaptopropionate); ethylene glycol bis(thioglycolate); ethylene glycol bis($\beta$-mercaptopropionate) and poly(propylene oxide ether) glycol bis($\beta$-mercaptopropionate).

Preferably, the coating compositions of the invention will also contain from about 0.1 to about 10 parts by weight, per 100 parts combined weight of unsaturated oligomer and reactive diluent, of acrylic acid.

The invention compositions can also include pigments, fillers, wetting agents, flow control agents, and other additives typically present in coating compositions. In some applications, the inclusion of minor amounts of inert solvents can be advantageous. Such additive materials are well-known to those skilled in the art and do not require further elaboration herein. Also well-known are the concentrations at which such additives are used.

The coating compositions of this invention are prepared by conventional methods such as blending. The compositions can be applied to wood, metal, fabric and plastic substrates in an economical and efficient manner using conventional industrial techniques and provide smooth, uniform films which are rapidly cured to dried films having a reduced gloss with excellent physical and chemical properties.

Energy-curable compositions comprising reactive oligomer, reactive diluent system, silica and photocatalyst system as described herein are cured to a film having a low gloss finish by subjecting the wet film to actinic radiation in an oxygen-enriched atmosphere at gradient intensity cure conditions. As the name "Gradient Intensity Cure" implies, this method of gloss control involves the use of two or more intensity levels to effect total cure of the energy-curable compositions. The "Gradient Intensity Cure" method of gloss control can provide 60° gloss values below 10 with essentially non-volatile energy curable coating formulations. The process requires that such compositions contain finite amounts of silica as the flatting pigment and also requires that the free radical-initiated addition polymerization of reactive oligomer and reactive diluent be effected in an oxygen-enriched atmosphere.

More particularly, the "Gradient Intensity Cure" process of the present invention comprises subjecting an energy-curable composition comprising reactive oligomer, reactive diluent, silica and photocatalyst system as defined herein to actinic radiation in an oxygen-enriched atmosphere at a first intensity level under conditions effective to substantially cure all but the surface of the coating and subsequently subjecting such composition to actinic radiation in an oxygen-enriched atmosphere at a second and higher intensity level under conditions effective to completely cure said surface. In certain cases, more than two intensity levels can be advantageously used, according to the concept $L_1 < L_2 < L_3 < L_4 \ldots < L_\infty$.

Generally speaking, molecular oxygen in the atmosphere surrounding the film is inhibitory to the full curing of free radical photopolymerizable resin-forming masses. In such an instance, the surface in contact with the oxygen-containing atmosphere remains undercured. Any ozone present is especially inhibiting to full curing. The "Gradient Intensity Cure" method of this invention takes advantage of this normally adverse phenomenon by employing the herein described photosensitizer-photoinitiator photocatalyst systems to cure the film in a sequential manner in the presence of an oxygen-containing atmosphere. In accordance with the "Gradient Intensity Cure" method, the coating is first irradiated by actinic light in an oxygen-containing atmosphere, with air being the preferred atmosphere, at a first intensity level which is sufficient to energize the photoinitiator component of the photocatalyst system and initiate free radical polymerization of the bulk of the coating. While actinic radiation has an emission spectra which is sufficient to energize also the photosensitizer component of the photocatalyst system, both the amount of photosensitizer and the first intensity level are selected to ensure that the free radicals produced from such energizing of the photosensitizer are insufficient to override completely oxygen inhibition at the film surface. The surface of the coating is thus inhibited at the first intensity level by the oxygen present in the curing atmosphere at least to the extent that the surface is incompletely polymerized and remains wet to the touch while the bulk or underneath portion of the coating is cured to a hard polymer. This formation of two distinct layers is a necessary feature of Gradient Intensity Cure gloss control. During exposure of the film to the first intensity level, the underneath portion of the film is cured to a hard polymer and undergoes some amount of shrinkage which is effective to force a small amount of silica into the wet surface layer, thereby increasing the silica to binder ratio in the surface layer. The surface layer is partially polymerized to a soft gel-like state which remains wet to the touch but does have sufficient rheological properties to support the silica particles. While the energy-curable compositions are essentially non-volatile, some amount of evaporation does take place at the surface of the film which causes the silica to be exposed. Even though exposed, the silica appears to be coated with a thin film of binder composition. The net effect is a significant increase in the silica to binder ratio in the thin surface film. To the extent that the silica particles are coated with the thin film of binder composition, the partially polymerized wet surface film will have some degree of gloss which will be maintained during the subsequent treatment at a second and higher intensity.

Following the exposure at the first intensity level, the wet film is irradiated by actinic light in an oxygen-containing atmosphere, with air again being the preferred atmosphere, at a second intensity level which is not only higher than that initially employed but also is effective to energize the photosensitizer component of the photocatalyst system. This second intensity level must be sufficiently high to ensure that the gross amount of free radicals resulting from such energization of photosensitizer is effective to override oxygen inhibition at the film surface and initiate free radical polymerization of and effect complete cure of the wet surface layer. Properties such as stain, solvent and abrasion resistance are substantially identical in comparison to formulations cured according to the two-stage air-inert environment process of Hahn U.S. Pat. No. 3,918,393, or cured in a single stage at constant intensity in either an inert atmosphere or an oxygen-containing atmosphere.

The actinic energy which is employed in the "Gradient Intensity Cure" method of gloss control is ultra violet light or ultraviolet radiation in the near and far ultraviolet spectrum, i.e., having wavelengths in the range of 200 NM (nanometers) to 400 NM. Various suitable sources of such ultraviolet light or radiation are available in the art including by way of example, mercury vapor arc lamps, ultra violet-cured carbon arcs, plasma arc torches, ultra violet lasers, and pulsed xenon lamps, with medium pressure mercury arc vapor lamps being currently preferred.

Control of the intensity of radiant energy which is applied to the workpiece, that is, coated substrate, is a critical feature of the present invention. As used herein, the term "intensity" is defined as the flux density, that is, the total number of photons or quanta/sec., impinging upon the energy curable coating, and is thus a function not only of the amount of radiant energy coming from a given source at a particular wavelength or wavelengths (quanta/sec.) but also of the exposure time. For any particular wavelength from a given source, the amount of photons or quanta/sec. is readily obtained from the equation $$\text{Photons or quanta/sec.} = \frac{(\text{Power, milliwatts})\,(\text{Wavelength, nanometers})\,(10^{13})}{1.987}$$

Thus, within the near to far ultraviolet spectrum of 200–400 nanometers, the energy at the coating can be varied by effecting changes in one or more of the parameters of power, wavelength and exposure time.

As noted, intensities, that is, flux densities, must be selected which result in the sequential curing of the bulk or underneath portion of the coating followed by curing of the surface. Thus, in accordance with the invention, there is selected a first intensity level, which can be either a discrete value or a finite range, which, in combination with the exposure time, is effective to provide an amount of photons effective to energize the photoinitiator component of the photocatalyst system and initiate free radical polymerization of reactive oligomer and reactive monomer but ineffective to energize the photosensitizer component of the photocatalyst system to the degree necessary to override oxygen inhibition of free-radical polymerization at the surface of the coating. Exposure at the first intensity should be continued until all but the surface of the coating is essentially cured to a hard polymer. The coating is then exposed to at least one other but higher intensity level, which, again can be a discrete value or a finite range, which, again in combination with the exposure time, is effective amount of photons effective to energize a sufficient amount the photosensitizer component of the photocatalyst system to completely overcome oxygen inhibition at the film surface. Exposure at the higher flux density level necessary to effect curing of the surface portion of the coating should continue until the entire coating is substantially completely cured to a hard polymer. The higher intensity level required for curing of the surface of the film can be attained in several ways, depending upon the power source, such as by increasing power, increasing exposure time, and through the use of such devices as shaped reflected, absorbing surfaces, quartz filters, lamp envelopes, liquid filters, and continuously variable power settings. Other methods of controlling both high and low density levels will be readily apparent to the photochemist. Exposure times at the higher intensity levels can, of course, be less than, equal to, or greater than the exposure time at low intensity. The primary requirement of the higher intensity level is the provision of sufficient photons in energizing the photosensitizer to initiate free radical polymerization of reactive oligomer and reactive diluent in the surface portion of the coating and override oxygen inhibition at the film surface, thus enabling the surface to become completely cured.

The intensity levels required to cure sequentially and fully bulk and surface portions of any particular energy-curable composition in accordance with Gradient Intensity Cure method of gloss control is a function also of the photocatalyst system. As pointed out, the Gradient Intensity Cure method of gloss control is effected in an oxygen-containing atmosphere using a photocatalyst system comprising a mixture of at least one photosensitizer and at least one photoinitiator. Each of the photosensitizer component, the photoinitiator component and surface oxygen will absorb energy emitted for the ultraviolet source in accordance with its individual absorption spectrum. In addition, each component of the photocatalyst systems must be capable of producing free radicals which can initiate polymerization of the reactive oligomer and reactive diluent components of the coating compositions, and which are also reactive with oxygen in the ground or unexcited state. Thus, in accordance with this invention, the initial (low) intensity level or range must provide a flux density which is effective to generate sufficient free radicals by excitation of the photoinitiator component to fully polymerize the bulk or underneath portion of the coating while, at the same time, being ineffective to generate sufficient free radicals by excitation of the photosensitizer component to override oxygen inhibition at the film surface. Subsequent (higher) intensity level or levels must provide an amount of energy which is effective to generate sufficient free radicals by excitation of the photosensitizer component to override completely oxygen inhibition at the film surface and to effect complete polymerization of the surface layer.

Thus, the makeup, that is, the relative amounts of photosensitizer and photoinitiator, of the photocatalyst system is important. Each component will be employed in an amount which is effective to accomplish the desired result, i.e., initial full cure of the bulk portion of the coating followed by full cure of the surface portion of the coating. More specifically, the photoinitiator component will generally be present in an amount in the range from 0.01 to 10, preferably 0.05 to 7, parts by weight per 100 parts by combined weight of reactive oligomer and reactive diluent. With respect to the photosensitizer, while the amount of this component is critical, it will be appreciated that the amount is not, in practical terms, readily susceptible to precise numerical delineation. The amount of photosensitizer which will be employed with a specific amount of photoinitiator must be sufficient to generate, when excited at the higher intensity level or levels, sufficient free radicals to overcome oxygen inhibition at the film surface and fully polymerize the surface portion of the coating, within a commercially acceptable exposure time. At the same time, the amount of photosensitizer must be insufficient to generate, due to excitation at the initial low intensity level, sufficient free radicals to overcome oxygen inhibition at the film surface and polymerize the surface portion of the coating simultaneously with the polymerization of the bulk portion. Such simultaneous polymerization of bulk and surface portions will result in a glossy finish. The photochemist will appreciate that the relative amounts of photosensitizer and photoinitiator, as well as low and high intensity levels, which would be required with any energy-curable coating to achieve the desired result can be readily determined by routine laboratory experimentation. As a guide, in a photocatalyst system employing benzophenone as photosensitizer and benzoin isobutyl ether as photoinitiator, the amount of benzophenone must be in the range of 1–3 parts by weight per 100 parts by combined weight of reactive oligomer and reactive diluent. At amounts below 1 part by weight benzophenone, an unacceptably lengthy exposure time is required to effect curing of the surface portion of the film. At amounts above 3 parts by weight benzophenone, the surface portion of the coating cures simultaneously with the bulk portion, giving a gloss finish.

It has been found that optimum gloss control is achieved when the viscosity of the coating is such as to ensure the existence of a stable homogeneous dispersion of silica in the reactive oligomer-reactive diluent vehicle. Thus, at times it will be desirable to heat the coatings to achieve this desired viscosity level. Viscosities which are so low as to allow the silica particles to precipitate or so high as to essentially immobilize the silica particles are undesirable and should be avoided. In some instances, it can be advantageous to postheat the cured film, as by infrared irradiation.

The invention is illustrated in greater detail by the following Examples, but these examples are not to be construed as limiting the present invention. All parts, percentages and the like are in parts by weight, unless otherwise indicated.

EXAMPLE I

An unsaturated oligomer syrup is prepared by reacting 1 mol of polyester polyol (1,3-butylene glycol/glycerine/adipic acid/isophthalic acid condensation product) having a hydroxyl functionality of 2.3 and 3.5 mols isophorone diisocyanate in 2-ethylhexyl acrylate diluent. The resulting isocyanatefunctional oligomer is fully capped with 2-hydroxylethyl acrylate to afford a syrup of addition-polymerizable unsaturated oligomer in 2-ethylhexyl acrylate reactive diluent at 70 percent resin solids. The unsaturated oligomer has a molecular weight CA. 1,300 and approximately 1.8 units of vinyl unsaturation per 1000 units of molecular weight. The syrup is identified hereinafter as Syrup A.

EXAMPLE II

Using Syrup A of Example I, an energy-curable coating is prepared from the following ingredients:

| Ingredient | PBW |
|---|---|
| Syrup A | 100 |
| 2-ethylhexyl acrylate | 10 |
| Silica | 10.3 |
| Acrylic acid | 2.3 |
| ν-methacryloxypropyltrimethoxy silane | 0.75 |
| Benzoin isobutyl ether | 1.0 |
| Benzophenone | 1.5 |

The resulting coating composition is applied by direct roll coater to vinyl sheet goods. The coating is subjected to ultraviolet irradiation in air, using a source consisting of 2 medium pressure mercury vapor lamps at a power output of 40 watts/cm. at a transport speed of 10 meters/minute. The coated vinyl sheet goods are then subject to ultraviolet irradiation in air at a higher intensity provided by a source consisting of 3 medium pressure mercury vapor lamps at a power output of 80 watts/cm. at a transport speed of 10 meters/minute.

The fully cured coated sheet vinyl goods are compared to sheet vinyl goods coating with the same composition but cured by ultraviolet irradiation as follows:

(1) in nitrogen using a power source consisting of 2 medium pressure mercury vapor lamps at a power output of 40 W/cm. at a transport speed of 10 m/min;

(2) same as (1), except that power source consists of 3 medium pressure mercury vapor lamps at a power output of 80 W/cm.;

(3) in air using a power source consisting of 2 medium pressure mercury vapor lamps at a power output of 40 W/cm. at a transport speed of 10 m/min., and then in nitrogen using the same power source at the same transport speed; and (4) same as (3), except that power source consists of 3 medium pressure mercury vapor lamps at a power output of 80 W/cm.

The physical strength of the coating in each instance is substantially equivalent. The coating cured according to the gradient intensity method of gloss control has a gloss of 45–50 as measured by the 60° gloss meter, as did the conparative coating cured by alternate process (3); whereas the comparative coatings cured by alternate processes (1), (2), and (4) have a high gloss finish.

The 60° gloss meter test is a standard test for gloss wherein light is reflected of the coating at a 60° angle and the percent reflectance is measured. The test is a standard ASTM D-523-67 test for evaluating gloss.

EXAMPLE III

A coating formulation having a composition identical to that of Example II is heated to 38° C. and is applied by direct roll coater to blown and unblown sheet vinyl goods which have been preheated to 66°–77° C. The coatings are cured by exposure to ultraviolet irradiation in an air atmosphere under the conditions as set forth and with the results reported in Table I.

EXAMPLE IV

The coating formulation of Example III, heated to 38° C., is applied to unblown vinyl sheet goods which have been preheated to temperatures over the range from 21° C. to 116° C.

TABLE I

| | Low Intensity Level | | | | High Intensity Level | | | | 60° Gloss | |
|---|---|---|---|---|---|---|---|---|---|---|
| Run No. | Lamps, No. | Power, W/cm. | Passes, No. | Transport Speed, M/min | Lamps, No. | Power, W/cm. | Passes, No. | Transport Speed M/min | Blown Vinyl | Unblown Vinyl |
| 1 | 2 | 40 | 1 | 5 | 3 | 30 | 1 | 33 | 30 | 18 |
| 2 | 2 | 40 | 1 | 10 | 3 | 80 | 1 | 33 | 16 | 15 |
| 3 | 2 | 40 | 1 | 15 | 3 | 80 | 1 | 33 | 13 | 11 |
| 4 | 2 | 40 | 1 | 20 | 3 | 80 | 1 | 33 | 13 | 12 |
| 5 | 2 | 40 | 1 | 25 | 3 | 80 | 1 | 33 | 16 | 13 |
| 6 | 2 | 40 | 1 | 30 | 3 | 80 | 1 | 33 | 19 | 12 |
| 7 | 2 | 40 | 1 | 35 | 3 | 80 | 1 | 33 | 27 | 13 |

The coatings are cured by exposure to ultraviolet irradiation in an air atmosphere at a low intensity level provided by a source consisting of 2 medium pressure mercury vapor lamps at a power output of 40 W/cm. at a transport speed of 10/m/min., followed by exposure to ultraviolet irradiation in an air atmosphere at a higher intensity level provided by a source consisting of 3 medium pressure mercury vapor lamps at a power output of 80 W/cm. at a transport speed of 10 m/min. The results are reported in Table II: below

| Temperature, °C. Uncoated Vinyl | 60° Gloss |
|---|---|
| 21 | 25 |
| 38 | 22 |
| 52 | 12 |
| 66 | 11 |
| 77 | 16 |
| 77 | 12 |
| 77 | 14 |
| 82 | 12 |
| 92 | 16 |
| 107 | 24 |
| 116 | 25 |

EXAMPLE V

The coating formulation of Example III, heated to 38° C., is applied to vinyl asbestos substrates by direct roll coater. The coated substrates are cured by exposure to ultraviolet irradiation following the procedure of Example IV. The fully cured coatings are then heated by infrared irradiation at temperatures in the range from 49° C. to 70° C. In each instances, postheating of the cured coatings adversely affected flatting in all cases where the substrate had preheated prior to applying the coating but improved flatting in all cases where the substrate had not been preheated. The beneficial effect of postheating the fully cured film is important since many substrates cannot be preheated without an adverse effect such as curling or warping.

EXAMPLE VI

Energy-curable coating formulations are prepared as follows:

| Formulation | A | B | C | D | E | F | G |
|---|---|---|---|---|---|---|---|
| Ingredients: | | | | | | | |
| Syrup A | 100 | 100 | 100 | 100 | 100 | 100 | 100 |
| 2-ethylhexyl acrylate | 10 | 10 | 10 | 10 | 10 | 10 | 10 |
| Silica | 10.3 | 10.3 | 10.3 | 10.3 | 10.3 | 10.3 | 10.3 |
| Acrylic acid | 2.3 | 2.3 | 2.3 | 2.3 | 2.3 | 2.3 | 2.3 |
| γ-methacryloxypropyl-trimethyoxy silane | 0.75 | 0.75 | 0.75 | 0.75 | 0.75 | 0.75 | 0.75 |
| Benzoin isobutyl ether | 1.0 | 1.0 | 1.0 | 1.0 | 1.0 | 1.0 | 1.0 |
| Benzophenone | 0 | 0.5 | 1.0 | 1.5 | 2.0 | 2.5 | 3.0 |

The compositions are applied by direct roll coater to aluminum panels. The coatings are cured by exposure to ultraviolet irradiation in an air atmosphere at the following conditions:

Low intensity, 1 pass, 40 W/cm., 10 m/min. transport speed.

High intensity, 1 pass, 120 W/cm., 10 m/min. transport speed.

In all cases, curing of the bulk portion with a wet surface film is effected at the exposure in air to the low intensity cure cycle. At the high intensity cure cycle, full cure of the surface portion of the coating is not obtained with formulations VI-A and VI-B. Full cure of the coating with low gloss finished are obtained with formulations VI-C, VI-D, VI-E, VI-F and VI-G; however, the reduction in gloss is less for formulation VI-G than for the others. Gloss reduction, decreasing from best to worst, is as follows: VI-D>VI-E>VI-C>VI-F>VI-G. It appears that the surface cure rate begins to approach the bulk cure rate as the ratio of photosensitizer:photoinitiator is increased.

EXAMPLE VII

Energy-curable coating formulations are prepared from the following ingredients:

| Formulation | A | B |
|---|---|---|
| Syrup A | 58.3 | 56.3 |
| Tetraethylene glycol diacrylate | 20.0 | 19.3 |
| Trimethyloylpropane triacrylate | 0.5 | 0.5 |
| 2-hydroxyethyl methacrylate | 4.7 | 4.7 |
| Silica | 7.9 | 10.5 |
| ν-methacryloxypropyltrimethoxy silane | 4.2 | 4.1 |
| Acrylic acid | 1.0 | 1.0 |
| Benzophenone | 0.5 | 1.0 |
| Diethoxyacetophenone | 2.0 | 1.9 |

The formulations are applied by direct roll coater to vinyl sheet goods which have been preheated to 60° C. The coatings are cured by exposure to ultraviolet irration in an air atmosphere at the following conditions:

Low intensity, 1 pass, 40 W/cm., 10 m/min. transport speed;

High intensity, 1 pass, 80 W/cm., 10 m/min. transport speed.

Cured formulation VII-A has a 60° gloss value of 12. Cured formulation VII-B has a 60° gloss value of 7.

The data of Examples I–VII demonstrate the effectiveness of the Gradient Intensity Cure method of gloss control. The data further demonstrate the criticality of the relationship between photosensitizer and photoinitiator, as well as the beneficial effects which can be obtained by preheating the substrate and postheating the cured films. The data further demonstrate control of intensity levels by varying transport speed and power, inter alia.

What is claimed is:

1. A method for providing a surface having a reduced gloss finish comprising subjecting a substantially inert solvent-free, essentially 100% reactive composition comprising at least one reactive oligomer; at least one reactive monomer diluent; silica and an effective amount of a photo catalyst composition comprising (1) an effective amount of at least one photosensitizer compound which promotes free radical polymerization through bimolecular photochemical reactions of the energy donor type or hydrogen abstraction type or by formation of a donor-acceptor complex with monomers or additives leading to ionic or radical species and (2) an effective amount of at least one photoinitiator compound which promotes free radical polymerization by generating reactive specie by way of unimolecular scission resulting from photoexcitation to ultraviolet irradiation in an oxygen-containing atmosphere at a first intensity level and a first exposure time until such composition is substantially fully cured except for its surface and subsequently subjecting such composition to ultraviolet irradiation in an oxygen-containing atmosphere at at least one other intensity level and at at least one other exposure time until the surface of such composition is substantially fully cured, said other intensity level being higher than said first intensity level, and said other exposure time being less than, equal to or more than said first exposure time.

2. A method according to claim 1 wherein said higher intensity level has an average value at least 50 percent higher than the average value of said first intensity level.

3. A method according to claim 1 wherein said atmosphere contains at least 5,000 parts per million of oxygen.

4. A method according to claim 1 wherein said atmosphere is air.

5. A method according to claim 1 wherein the amount of said photoinitiator compound is in the range from 0.01 to 10 parts by weight, per 100 parts by weight of said reactive oligomer and said reactive monomer diluent, and the amount of said photosensitizer is in a range which is ineffective to generate sufficient free radicals from excitation at said first intensity level to overcome oxygen inhibition at the surface of said composition but is effective to generate sufficient free radicals from excitation at said higher intensity level to overcome oxygen inhibition at the surface and fully polymerize the surface of such composition.

6. A method according to claim 5 wherein said photosensitizer is benzophenone and said photoinitiator is benzoin isobutyl ether.

7. A method according to claim 5 wherein said photosensitizer is benzophenone and said photoinitiator is diethoxyacetophenone.

8. A coating composition comprising (a) at least one unsaturated oligomer, (b) a reactive diluent which is copolymerizable with said oligomer;

(c) from 1 to 12 parts by weight, per 100 parts by combined weight of said oligomer and said diluent, silica; and (d) an effective amount of a photocatalyst system comprising (1) an effective amount of at least one photosensitizer which promotes free radical photopolymerization through bimolecular photochemical reactions of the energy donor type or hydrogen abstraction type, or through formation of a donor-acceptor complex with monomers or additives leading to ionic or radical specie; and (2), an effective amount of at least one photoinitiator which promotes free radical photopolymerization by generating radical specie by way of linimolecular homolysis resulting from photoexcitation.

9. A coating composition according to claim 8 wherein the amount of said photocatalyst system is effective, when exposed to ultraviolet irradiation having a wavelength of 200 to 400 nanometers in an oxygen-containing atmosphere at a first intensity level $I_1$, to generate an amount of free radicals from excitation of such photosensitizer and such photoinitiator sufficient to cure all but the surface of such composition at said first intensity level, and, when exposed to such irradiation in an oxygen-containing environment at a second intensity level $I_2$, said level $I_2$ being higher than said level $I_1$, is effective to generate sufficient free radicals from excitation of said photosensitizer to substantially cure the surface of such composition.

10. A coating composition according to claim 9 wherein the amount of said photosensitizer is in the range from 0.01 to 10 parts by weight, per 100 parts by weight of said reactive oligomer and said reactive monomer diluent.

11. A coating composition according to claim 10 wherein said photosensitizer is benzophenone and said photoinitiator is benzoin isobutyl ether.

12. A coating composition according to claim 10 wherein said photosensitizer is benzophenone and said photoinitiator is diethoxyacetophenone.

* * * * *